US008402903B2

(12) United States Patent
Tseng et al.

(10) Patent No.: US 8,402,903 B2
(45) Date of Patent: Mar. 26, 2013

(54) FEED DOG DEVICE FOR A SEWING MACHINE

(75) Inventors: Shui-Chun Tseng, Taiping (TW); Hsueh-Hua Liu, Taiping (TW); Huan-Chi Hsu, Taiping (TW)

(73) Assignee: Zeng Hsing Industrial Co., Ltd., Taiping (TW)

( * ) Notice: Subject to any disclaimer, the term of this patent is extended or adjusted under 35 U.S.C. 154(b) by 0 days.

(21) Appl. No.: 13/014,888

(22) Filed: Jan. 27, 2011

(65) Prior Publication Data

US 2012/0079974 A1 Apr. 5, 2012

(30) Foreign Application Priority Data

Oct. 1, 2010 (TW) ..... 99133522 A

(51) Int. Cl.
*D05B 27/00* (2006.01)

(52) U.S. Cl. ..... 112/324

(58) Field of Classification Search ..... 112/324, 112/27, 47, 260, 312, 323, 316, 317, 319, 112/80.32
See application file for complete search history.

(56) References Cited

U.S. PATENT DOCUMENTS 1,603,246 A * 10/1926 Rocke ..... 112/152
2,548,361 A * 4/1951 Ginwright ..... 112/324
4,145,983 A * 3/1979 Law et al. ..... 112/317
4,423,693 A * 1/1984 Hanyu et al. ..... 112/324
4,895,089 A * 1/1990 Adams ..... 112/316
4,934,293 A * 6/1990 Yokota et al. ..... 112/288
6,332,418 B2 * 12/2001 Hayashi ..... 112/260

FOREIGN PATENT DOCUMENTS

TW 592225 U 6/2004
TW M326536 U 2/2008

OTHER PUBLICATIONS

Office Action for Taiwanese Patent Application No. 099133522, dated Nov. 1, 2012, 1 page.

* cited by examiner

*Primary Examiner* — Tejash Patel
(74) *Attorney, Agent, or Firm* — Kilpatrick Townsend & Stockton LLP

(57) ABSTRACT

A feed dog device for a sewing machine includes a feed dog mount mounted under a needle plate and having a feed dog mounted thereon to permit the feed dog to extend through slots in the needle plate. The feed dog mount is coupled with a lever through a force transmitting unit to couple an increased torque generated by a pivotal movement of the lever to the feed dog mount so as to enable a weight end of the lever to drive the feed dog mount to move reciprocatingly in a transverse direction perpendicular to a normal feeding direction of a fabric. The lever is actuated by a cam follower with a torque generated as a result of transmission through a rotary cam member which is rotated with an output shaft of the drive member. Since the feed dog can be reciprocatingly moved in the transverse direction, the sewing machine can perform a variety of sewing operations.

10 Claims, 7 Drawing Sheets

FEED DOG DEVICE FOR A SEWING MACHINE

BACKGROUND OF THE INVENTION

1. Field of the Invention

This invention relates to a fabric feeding device for a sewing machine, more particularly to a feed dog device which permits a fabric to be fed past the stitch forming area of the sewing machine in a transverse direction perpendicular to a normal feeding direction.

2. Description of the Related Art

It has been known that sewing machines have multiple functions for performing a variety of sewing operations to meet a user's requirement, such as flat stitching, hemming, embroidering, etc. In performing an embroidering operation, a conventional sewing machine is generally provided with a sewing needle which is driven to make a laterally reciprocating movement so as to embroider or stitch patterns onto a garment or fabric. However, the lateral movement of the needle is limited so that the size of patterns to be stitched is relatively small, thereby limiting the choice of patterns.

A bi-directional feed dog mechanism for a sewing machine is disclosed in U.S. Pat. No. 4,539,925 and includes a driven rod for producing forward and backward reciprocating movement of a feed dog for moving a fabric past a stitch forming area. The driven rod is connected to a power rod via a slidable clutch member that is coupled with a feed-dog support via a connector and an arm. Rotation of the power rod results in reciprocation of the arm and the feed-dog support in a lateral direction for creating a sideways reciprocation of the feed dog. Such reciprocating motion of the mechanism can not be controlled by actuation of a servo motor, and can not perform a desired sewing operation.

It is desirable to improve a fabric feeding mechanism to permit a fabric to be fed in a transverse direction perpendicular to a normal feeding direction so as to permit the sewing machine to perform a variety of sewing operations.

SUMMARY OF THE INVENTION

An object of the present invention is to provide a feed dog device for a sewing machine which can move a feed dog in a transverse direction perpendicular to a normal feeding direction so as to permit the sewing machine to perform a variety of sewing operations.

According to this invention, the feed dog device includes a platform adapted to be mounted under a table of a sewing machine and spaced apart from a needle plate in a transverse direction, a drive member disposed under the platform and having an output shaft which extends upwardly of the platform and which is rotatable about an upright axis, a rotary cam member mounted on and swingable with the output shaft, and defining a cam path which extends angularly about the upright axis and which terminates at forward and backward limits, a cam follower guided by the cam path and disposed such that, when the forward and backward limits are brought to respectively engage the cam follower by virtue of swinging movement of the rotary cam member about the upright axis, the cam follower is displaced radially between proximate and distal positions relative to the upright axis, a lever disposed on the platform to pivot about a fulcrum axis oriented parallel to the upright axis, and having weight and power ends which are configured such that, when the power end is actuated by a torque generated by displacement of the cam follower, the weight end is moved relative to the fulcrum axis by an increased torque between rightward and leftward positions in the transverse direction, a feed dog mount adapted to be mounted under the needle plate and having a feed dog mounted thereon to permit the feed dog to extend through slots in the needle plate, and a force transmitting unit disposed to couple the increased torque of the weight end to the feed dog mount so as to reciprocatingly move the feed dog in the transverse direction when the weight end is displaced between the rightward and leftward positions.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
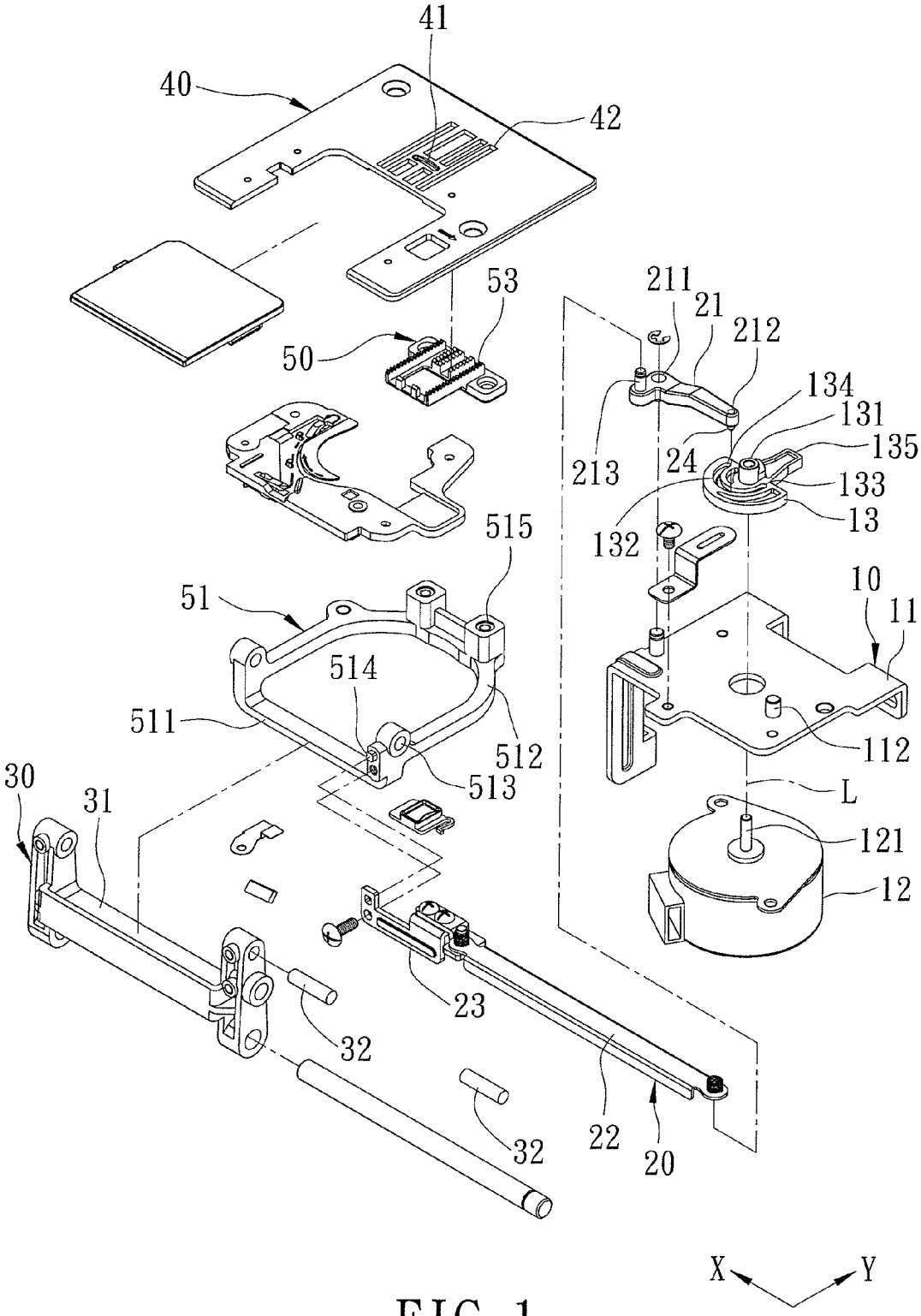
FIG. 1 is an exploded perspective view of the preferred embodiment of a feed dog device according to this invention.
Figure 2:
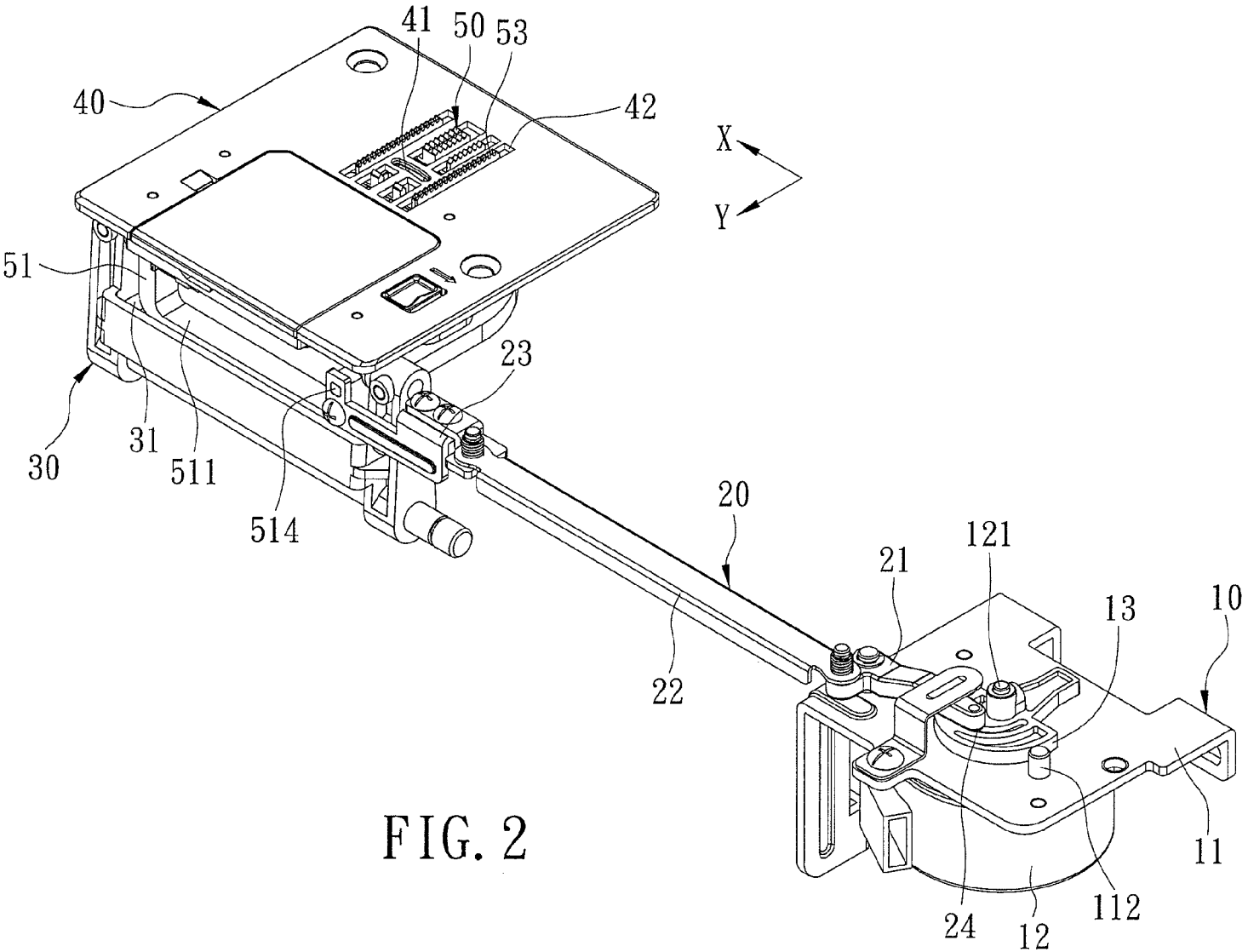
FIG. 2 is a perspective view of the preferred embodiment.

Referring to FIGS. 1 to 4, the preferred embodiment of a feed dog device for a sewing machine according to the present invention is adapted to be mounted under a table of a sewing machine that is fitted with a needle plate 40. The needle plate 40 has an elongated needle hole 41 and a plurality of slots 42 adjacent to the needle hole 41. The slots 42 are elongated in a longitudinal direction (Y) (i.e., a normal feeding direction), and are spaced apart from one another in a transverse direction (X) for extension of teeth 53 of a feed dog 50 therethrough. The width of each slot 42 in the transverse direction is larger than that of the teeth 53. The feed dog device of this embodiment is shown to comprise a driving unit 10, a cam follower 24, a lever 21, a feed dog mount 51, and a force transmitting unit 20.

The driving unit 10 includes a platform 11 adapted to be mounted under the table of the sewing machine and spaced apart from the needle plate 40 in the transverse direction (X), a drive member 12 in the form of a servo motor 12 and mounted under the platform 11 to have an output shaft 121 extending upwardly through the platform 11 such that the output shaft 121 is actuated to rotate about an upright axis (L), and a rotary cam member 13 mounted on and swingable with the output shaft 121. The platform 11 has a stop 112 extending upwardly therefrom. The rotary cam member 13 has a connected portion 131 securely disposed on the output shaft 121, an arcuate slot 132 extending angularly about the upright axis (L) to define a cam path and to terminate at forward and backward limits 133, 134 that are disposed diametrically opposite to each other and that are respectively distant from the upright axis (L) by a shorter length (L1) and a longer length (L2), and a blocked portion 135 disposed at an opposite side of the arcuate slot 132.

The cam follower 24 is in the form of a follower pin 24 which is slidably engaged in the arcuate slot 132 to be guided by the cam path. Thus, by virtue of swinging movement of the rotary cam member 13 about the upright axis (L), when the forward and backward limits 133, 134 are brought to respectively engage the follower pin 24, the follower pin 24 is displaced radially between proximate and distal positions relative to the upright axis.

The lever 21 has a pivot portion 211 disposed on the platform 11 to pivot about a fulcrum axis oriented parallel to the upright axis (L), and power and weight ends 212, 213 at two opposite sides of the pivot portion 211. In this embodiment, the follower pin 24 is integrally formed with the power end 212 of the lever 21. The weight arm (between the weight end 213 and the pivot portion 211) is shorter than the force arm (between the power end 212 and the pivot portion 211), and is oriented transverse to the force arm. Hence, when the power end 212 is actuated by a torque generated by displacement of the follower pin 24, the weight end 213 is moved relative to the fulcrum axis by an increased torque between rightward and leftward positions in the transverse direction (X).

The feed dog mount 51 is mounted under the needle plate 40 and includes an arcuate frame 512, a crosspiece-like guided portion 511 disposed at one side of the arcuate frame 512, two connected lugs 513 disposed adjacent to two ends of the guided portion 511, a linking portion 514 disposed adjacent to one of the connected lugs 513, and a mounting portion 515 disposed at the other side of the arcuate frame 512 and spaced apart from the guided portion 511 in the longitudinal direction (Y). The feed dog 50 is securely mounted on the mounting portion 515.

The force transmitting unit 20 includes first and second linking bars 22, 23, and a guiding member 30. The first linking bar 22 has two linking ends respectively pivotably connected to the weight end 213 of the lever 21 and the second linking bar 23. The second linking bar 23 is pivotably connected to the linking portion 514 of the feed dog mount 51. The guiding member 30 is disposed to suspend the needle plate 40 and movable relative to the needle plate 40 in the longitudinal direction (Y). The guiding member 30 has a guiding rail 31 extending in the transverse direction (X) such that the guided portion 511 is disposed to be guided by and moved along the guiding rail 31, and two pins 32 disposed to be journalled in the connected lugs 513 to further guide the movement of the feed dog mount 51 in the transverse direction (X). Thus, by virtue of the force transmitting unit 20, the increased torque of the weight end 213 of the lever 21 can be coupled to the feed dog mount 51 so as to reciprocatingly move the feed dog 50 in the transverse direction (X) when the weight end 213 is displaced between the rightward and leftward positions.

The guiding member 30 is moved to impart fabric feeding motion to the feed dog 50 in the longitudinal direction (Y) by a driving mechanism (not shown), meanwhile, the feed dog device of this invention can perform the following motions.

Figure 3:
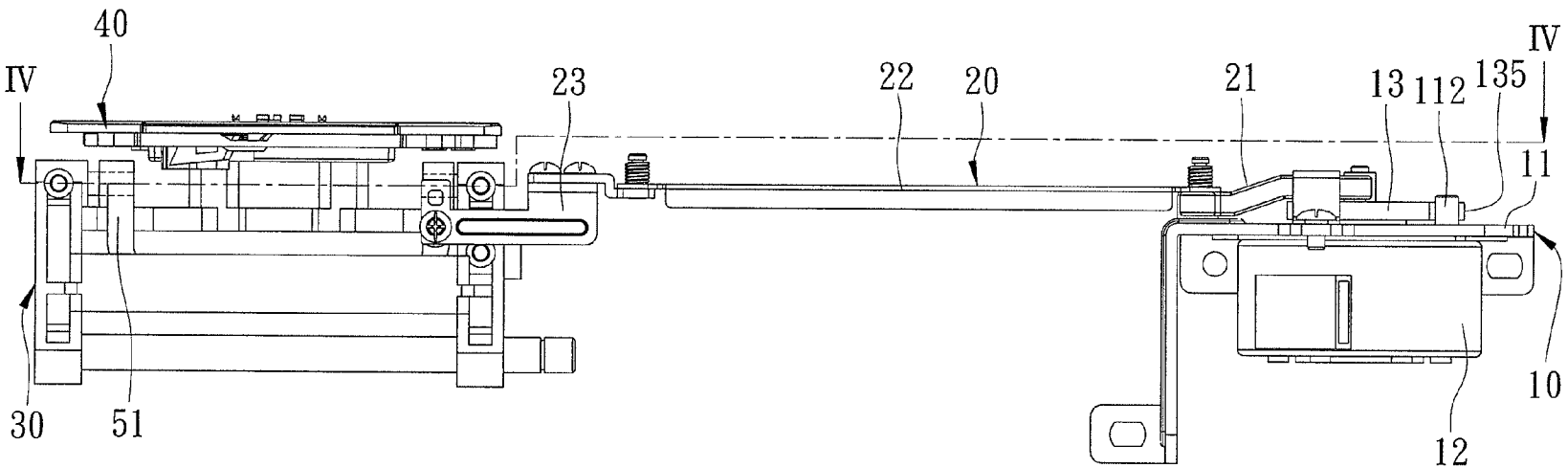
FIG. 3 is a front view of the preferred embodiment.
Figure 4:
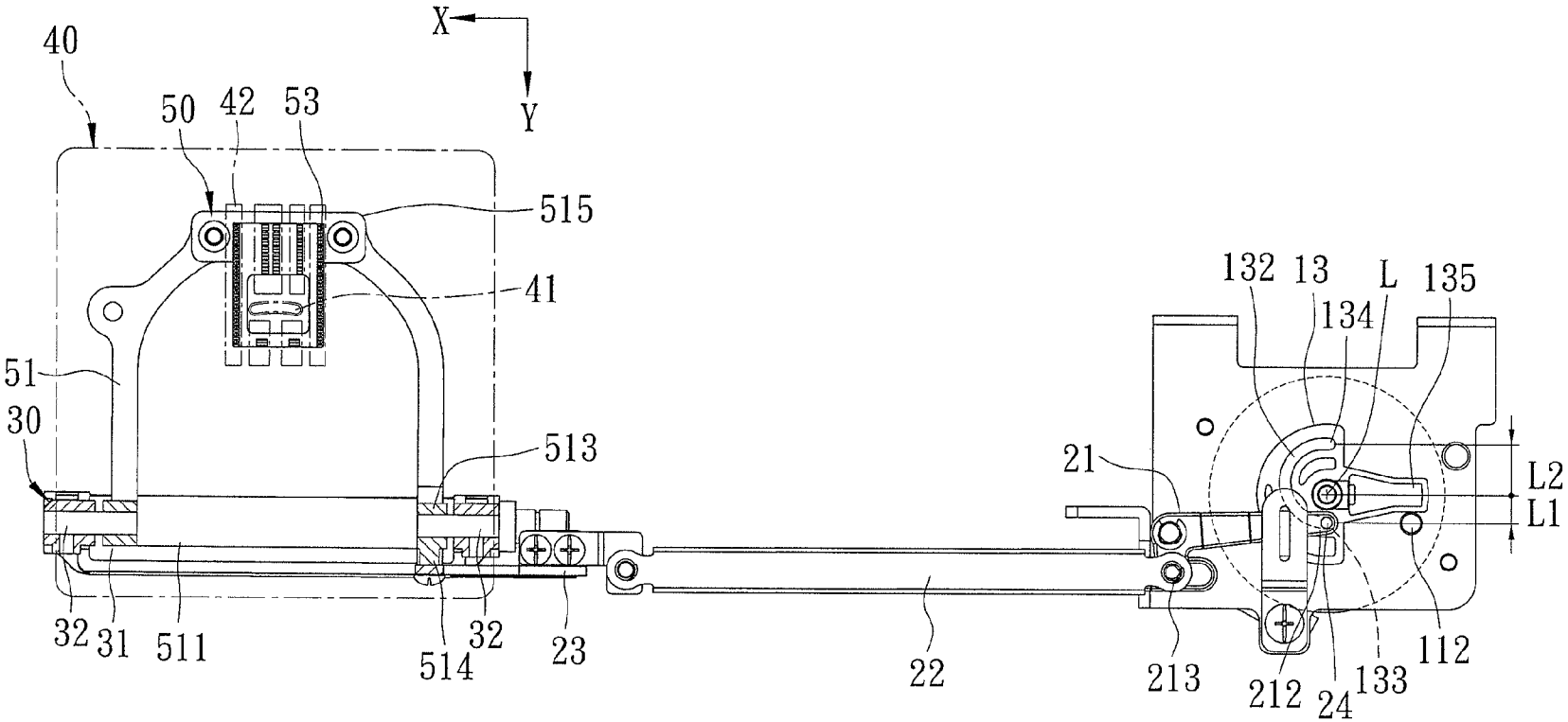
FIG. 4 is a sectional view taken along line IV-IV of FIG. 3 when a feed dog at the rightmost of slots.
Figure 5:
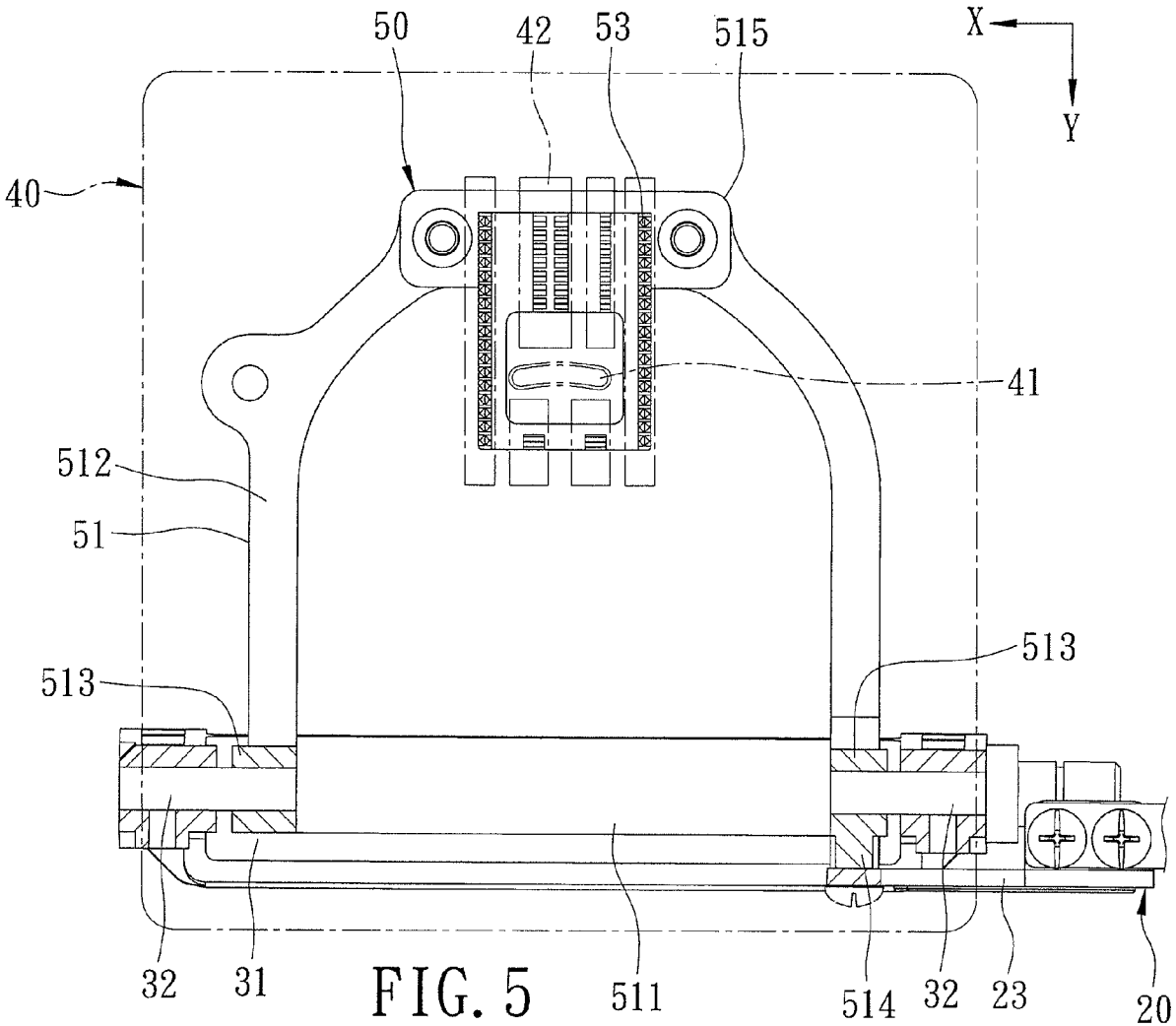
FIG. 5 is a fragmentary enlarged view of FIG. 4.

Referring to FIGS. 3 to 5, the cam follower 24 is in the proximate position so as to bring the weight end 213 in the rightward position, and the blocked portion 135 is blocked by the stop 112. At this stage, the teeth 53 of the feed dog 50 are at the rightmost of the slots 42.

Figure 6:
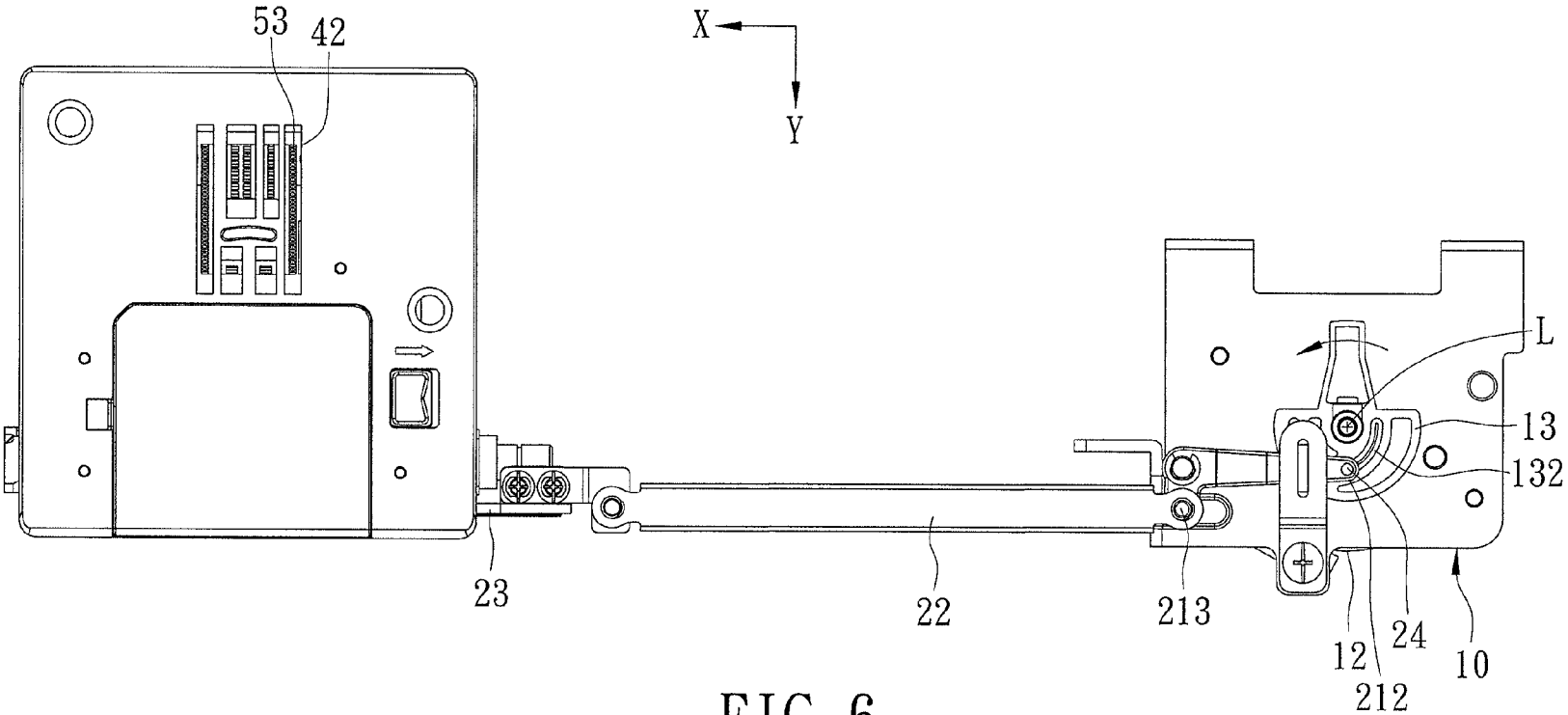
FIG. 6 is a sectional view similar to FIG. 4 when the feed dog at a middle position of the slots.

Referring to FIG. 6, when the drive member 12 is actuated to rotate the output shaft 121 as well as the rotary cam member 13 in a counterclockwise direction about the upright axis (L), the cam follower 24 is swung away from the upright axis (L) such that the weight end 213 is moved toward the leftward position. By virtue of the force transmitting unit 20, the feed dog mount 51 is moved leftward along the guiding rail 31 so as to move the teeth 53 of the feed dog 50 to a middle position of the slots 42.

Figure 7:
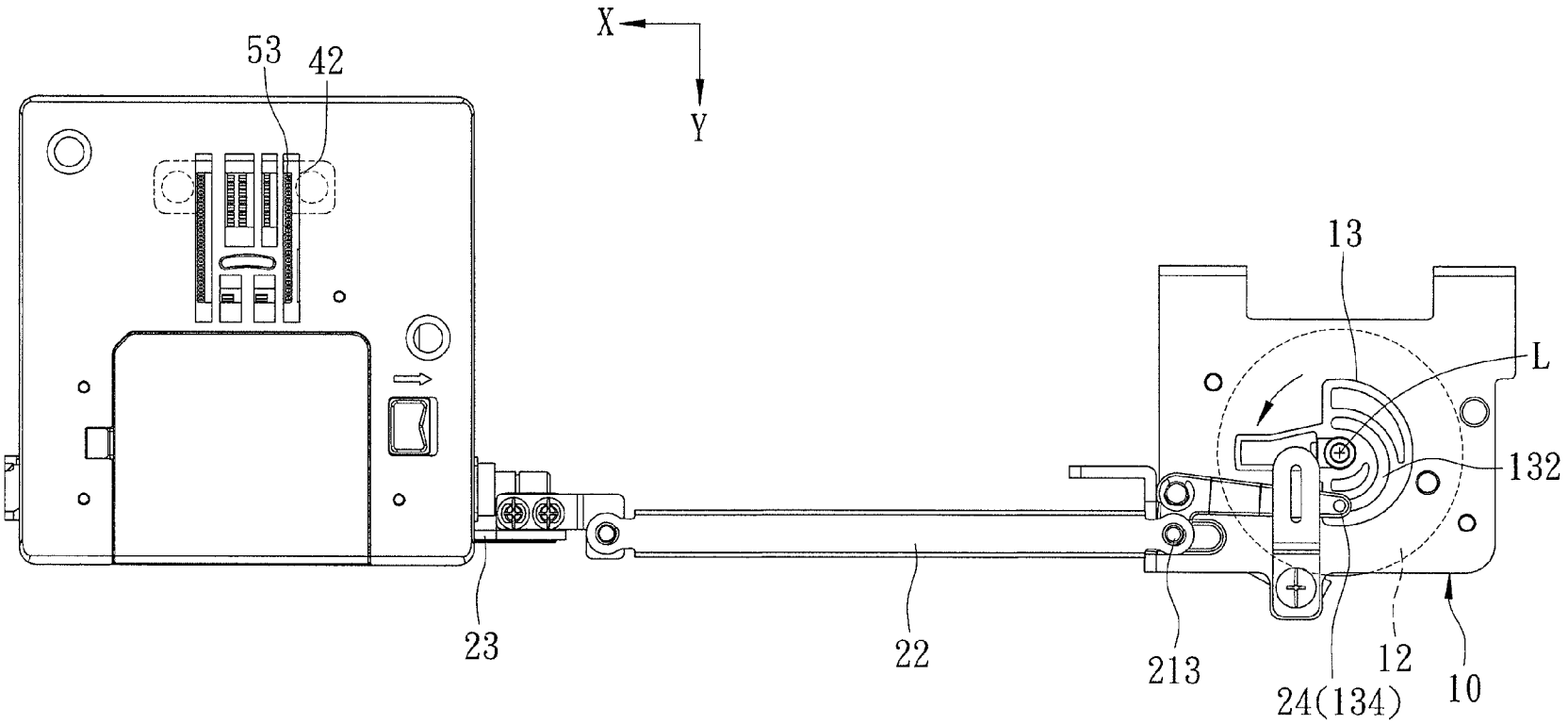
FIG. 7 is a sectional view similar to FIG. 4 when the feed dog at the leftmost of the slots.

Referring to FIG. 7, when the drive member 12 is continuously actuated to rotate the output shaft 121 and the rotary cam member 13 in the counterclockwise direction, the cam follower 24 is swung further away from the upright axis (L) to the distal position such that the weight end 213 is moved to the leftward position. Thus, the teeth 53 of the feed dog 50 are moved to the leftmost of the slots 42.

When the drive member 12 is actuated to rotate the rotary cam member 13 in a clockwise direction to move the cam follower 24 from the distal position to the proximate position such that the weight end 213 is moved from the leftward position to the rightward position, the teeth 53 of the feed dog 50 are moved back to the rightmost of the slots 42, until the blocked portion 135 is blocked from further movement by the stop 112.

As illustrated, since the feed dog 50 can be reciprocatingly moved in the transverse direction (X) perpendicular to the normal feeding direction, i.e., the longitudinal direction (Y), the sewing machine can perform a variety of sewing operations, such as a larger size and a variety of patterns can be stitched. In addition, by actuation of the servo motor 12, the cam follower 24 can be displaced to any desired position between the proximate and distal positions so as to permit the feed dog 50 to make a reciprocating movement in the transverse direction (X) in a precise and smooth manner.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

What is claimed is:

1. A feed dog device for a sewing machine which includes a table fitted with a needle plate defining a plurality of slots elongated in a longitudinal direction and spaced apart from each other in a transverse direction, said feed dog device comprising:

a platform adapted to be mounted under the table of the sewing machine and spaced apart from the needle plate in the transverse direction;

a drive member disposed under said platform and having an output shaft which extends upwardly of said platform and which is rotatable about an upright axis;

a rotary cam member mounted on and swingable with said output shaft, and defining a cam path which extends angularly about the upright axis and which terminates at forward and backward limits;

a cam follower guided by said cam path and disposed such that, when said forward and backward limits are brought to respectively engage said cam follower by virtue of swinging movement of said rotary cam member about the upright axis, said cam follower is displaced radially between proximate and distal positions relative to the upright axis;

a lever disposed on said platform to pivot about a fulcrum axis oriented parallel to the upright axis, and having weight and power ends which are configured such that, when said power end is actuated by a torque generated by displacement of said cam follower, said weight end is moved relative to the fulcrum axis by an increased torque between rightward and leftward positions in the transverse direction;

a feed dog mount adapted to be mounted under the needle plate and having a feed dog mounted thereon to permit said feed dog to extend through the slots; and a force transmitting unit disposed to couple the increased torque of said weight end to said feed dog mount so as to reciprocatingly move said feed dog in the transverse direction when said weight end is displaced between the rightward and leftward positions, wherein said cam follower is in the form of a follower pin which extends from said power end of said lever in a direction parallel to the fulcrum axis.

2. The feed dog device according to claim 1, wherein said follower pin is integrally formed with said power end of said lever.

3. The feed dog device according to claim 1, wherein said rotary cam member has an arcuate slot extending angularly about the upright axis to define the cam path such that said forward and backward limits are disposed diametrically opposite to each other and are respectively distant from the upright axis by shorter and longer lengths, said follower pin being slidably engaged in said arcuate slot.

4. The feed dog device according to claim 3, wherein said lever is configured such that a weight arm is shorter than a force arm.

5. The feed dog device according to claim 4, wherein said weight arm is oriented transverse to said force arm.

6. The feed dog device according to claim 4, wherein said drive member is a servo motor which is mounted under said platform to have said output shaft extending upwardly through said platform.

7. The feed dog device according to claim 3, wherein said platform has a stop extending upwardly therefrom, said rotary cam member having a blocked portion which is disposed to be blocked from further movement by said stop when said rotary cam member is displaced to bring said cam follower in the proximate position.

8. The feed dog device according to claim 1, wherein said force transmitting unit includes first and second linking bars which are pivotably connected to each other and which are pivotably connected to said weight end and said feed dog mount so as to transmit the increased torque of said weight end to said feed dog mount.

9. The feed dog device according to claim 7, wherein said force transmitting unit further includes a guiding member adapted to be disposed under the needle plate and having a guiding rail extending in the transverse direction, said feed dog mount having a guided portion which is disposed to be guided by and moved along said guiding rail.

10. The feed dog device according to claim 8, wherein said feed dog mount is connected to and movable relative to said guiding member.

* * * * *